US006513794B2

(12) United States Patent
Clements et al.

(10) Patent No.: US 6,513,794 B2
(45) Date of Patent: Feb. 4, 2003

(54) ENGINE HAVING CARBURETOR WITH BRIDGE CIRCUIT

(75) Inventors: Jeffrey L Clements, Kiel, WI (US); Gary L Stenz, Mt. Calvary, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/196,478

(22) Filed: Jul. 16, 2002

(65) Prior Publication Data

US 2002/0185754 A1 Dec. 12, 2002

Related U.S. Application Data

(62) Division of application No. 09/515,521, filed on Feb. 29, 2000.

(60) Provisional application No. 60/163,510, filed on Nov. 4, 1999.

(51) Int. Cl.[7] ..... F02M 3/12

(52) U.S. Cl. ..... 261/72.1; 123/184.23

(58) Field of Search ..... 261/40, 41.1, 41.5, 261/72.1, 39.5, DIG. 55; 123/184.23

(56) References Cited

U.S. PATENT DOCUMENTS

| | | | | |
|---|---|---|---|---|
| 1,435,151 | A | 11/1922 | Cole et al. | 261/41.1 X |
| 1,440,321 | A | 12/1922 | Webber | 261/41.1 X |
| 1,554,619 | A | 9/1925 | Bicknell | 261/41.5 |
| 1,567,171 | A | 12/1925 | Plaut | 261/41.5 |
| 1,582,187 | A | 4/1926 | Morris | 261/41.5 |
| 1,750,889 | A | 3/1930 | Heftler | 261/41.5 |
| 1,781,502 | A | 11/1930 | Ford | 261/41.5 |
| 1,831,056 | A | 11/1931 | Bicknell | 261/41.5 |
| 1,872,559 | A | 8/1932 | Bicknell | 261/57 |
| 1,916,062 | A | 6/1933 | Memini | 261/34.2 X |
| 1,925,430 | A | 9/1933 | Aseltine | 261/40 X |

(List continued on next page.)

FOREIGN PATENT DOCUMENTS

| | | |
|---|---|---|
| IT | 578442 A | 6/1958 |
| JP | 46-43049 | 12/1971 |
| JP | 55-148945 | 11/1980 |
| WO | WO 98/55757 | 12/1998 |

OTHER PUBLICATIONS

Mechanic's Handbook 3 to H.P. and OVM 120 (Light & Medium Frame) Tecumseh Engines, Tecumseh Products Company, Engine and Gear Service Division, Revised Nov. 1985, Form No. 692509, Section 2, pp. 2–3 through 2–9 (1985).

*Primary Examiner*—Richard L. Chiesa
(74) *Attorney, Agent, or Firm*—Baker & Daniels

(57) ABSTRACT

An internal combustion engine including a cylinder, a crankshaft, a reciprocating piston disposed in the cylinder and operably coupled to the crankshaft, and a carburetor. The carburetor includes an airflow passage through which varying amounts of air flows; a variably positioned throttle valve located in the airflow passage, the amount of air flowing through the airflow passage being varied in response to the position of the throttle valve; a source of stored liquid fuel; a well containing liquid fuel and in independent fluid communication with the source of stored liquid fuel; a nozzle extending between the liquid fuel contained in the well and the airflow passage, the nozzle having an outlet located upstream of the throttle valve in the airflow passage, a variable amount of the liquid fuel contained in the well being conveyed through the nozzle to the airflow passage in response to the amount of air flowing through the airflow passage; and an idle circuit in independent fluid communication with both the source of stored liquid fuel and the well, the idle circuit containing liquid fuel and having at least one fuel outlet located in the airflow passage downstream of the throttle valve, a variable amount of the liquid fuel contained in the idle circuit being conveyed to the fuel outlet in response to the amount of air flowing through the airflow passage. The engine may also include a governor mechanism by which the throttle valve is positioned in response to the speed of the crankshaft.

1 Claim, 7 Drawing Sheets

U.S. PATENT DOCUMENTS

| | | | | |
|---|---|---|---|---|
| 2,013,932 | A | 9/1935 | Viel | 261/41.5 |
| 2,048,428 | A | 7/1936 | Chandler et al. | 261/41.1 |
| 2,208,864 | A | 7/1940 | Farr | 261/41.5 |
| 2,462,696 | A | 2/1949 | Warburton | 261/51 |
| 2,839,154 | A | 6/1958 | Sterner | 183/20 |
| 2,985,159 | A | 5/1961 | Moseley | 261/72.1 X |
| 3,017,902 | A | 1/1962 | Goodyear | 261/41.1 X |
| 3,030,084 | A | 4/1962 | Phillips | 261/41.1 |
| 3,031,172 | A | 4/1962 | Rapplean | 261/72.1 X |
| 3,093,699 | A | 6/1963 | Demitz | 261/65 |
| 3,100,236 | A | 8/1963 | Ott et al. | 261/34 |
| 3,167,599 | A | 1/1965 | Brown et al. | 261/41.5 |
| 3,188,060 | A | 6/1965 | Kalert, Jr. | 261/23 |
| 3,215,413 | A | 11/1965 | Szwargulski et al. | 261/41 |
| 3,231,250 | A | 1/1966 | Kalert, Jr. | 261/41 |
| 3,233,878 | A | 2/1966 | Phillips | 261/23 |
| 3,269,713 | A | 8/1966 | Beck | 261/41 |
| 3,867,487 | A | 2/1975 | Matsumoto | 261/41.5 |
| 3,963,808 | A | 6/1976 | Garcea | 261/41 D |
| 4,108,123 | A | 8/1978 | Ito et al. | 261/41.5 X |
| 4,193,947 | A | 3/1980 | Bugamelli | 261/41 D |
| 4,268,462 | A | 5/1981 | Ota et al. | 261/40 |
| 4,329,964 | A | 5/1982 | Morris | 123/557 |
| 4,360,481 | A | 11/1982 | Kaufman | 261/39 R |
| 4,382,047 | A | 5/1983 | Brown et al. | 261/DIG. 39 |
| 4,578,228 | A | 3/1986 | Gerhardy | 261/41 D |
| 4,609,505 | A | 9/1986 | Tahata | 261/41.1 |
| 4,931,226 | A | 6/1990 | Ishii | 261/41.5 |
| 4,966,735 | A | 10/1990 | LoRusso | 261/40 |
| 4,982,715 | A | 1/1991 | Foster | 123/518 |
| 5,002,033 | A | 3/1991 | Housand, Sr. | 123/522 |
| 5,002,705 | A | 3/1991 | Kohler | 261/35 |
| 5,034,163 | A | 7/1991 | Baltz et al. | 261/34.1 |
| 5,386,145 | A | 1/1995 | Boswell | 261/41.1 |
| 5,662,077 | A | 9/1997 | Boswell | 123/184.21 |
| 6,149,140 | A | 11/2000 | Boswell | 261/40 |
| 6,196,524 | B1 | 3/2001 | Jourdan et al. | 261/39.5 X |
| 6,439,294 | B1 * | 8/2002 | Boswell | 261/40 X |

* cited by examiner

ENGINE HAVING CARBURETOR WITH BRIDGE CIRCUIT

CROSS-REFERENCE TO RELATED APPLICATION

This application is related to and claims the benefit under 35 U.S.C. §119(e) of U.S. Provisional Patent Application Ser. No. 60/163,510, filed Nov. 4, 1999.

BACKGROUND OF THE INVENTION

1. Field of the Invention

The invention relates generally to engines, and in particular to small gasoline engines, such as those used in lawn and garden implements.

2. Background Art

In a prior naturally aspirated four-cycle engine, such as engine 20 shown in FIGS. 1–3, carburetor 22 is provided in which air flowing therethrough is charged with fuel. The admixture of fuel and air flows through intake manifold 24 to which the carburetor is attached, and into intake port 26 of cylinder head 28. The cylinder head or, in the case of an L-head engine (not shown), the cylinder block, is provided with at least two valves (not shown), one of which is an intake valve past which the fuel/air mixture flows as it is drawn from the head into cylinder 30 having reciprocating piston 32 therein. The other valve is an exhaust valve past which exhaust gases exit cylinder 30 after combustion of the fuel/air mixture. As the piston moves away from the head, the intake valve is opened and the admixture is drawn into the cylinder. The intake valve is then closed and piston moves toward the head, the valves of which are now both closed. The admixture is thus compressed and is then spark-ignited in the conventional way, the expanding combustion gases forcing the piston away from the head, powering the engine. As the piston again approaches the head, the exhaust valve is opened and the exhaust gases are forced from the cylinder. The cycle then repeats as the piston again moves away from the head.

The intake strokes of the piston in the cylinder provide a continuous source of vacuum which acts to draw air through carburetor 22. The amount of vacuum, however, varies with the speed of the engine, which in turn is regulated by the amount and/or quality of the fuel/air mixture delivered to the cylinder. Referring now to FIG. 4A, the airflow passage through carburetor 22 has venturi portion 34, and the amount and/or quality of the fuel/air mixture delivered to cylinder 30 is controlled through pivoting throttle plate or throttle valve 36 located in the airstream, downstream of venturi throat 38. The angular position of the throttle plate is controlled by rotation of its attached shaft 40 to vary the amount of air allowed through the carburetor, and thus the pressure of the air at or near the venturi throat and the amount of fuel delivered to that air through open end 42 of tubular main jet nozzle 44, during off-idle running conditions. Opposite end 46 of main jet nozzle 44 extends into main jet well 48, and fuel is metered into main jet well 48 from the carburetor's fuel storage bowl 50 through metering jet passage 52 extending therebetween. The fuel in main jet well 48 provides a ready supply of fuel for main jet nozzle 44.

In its idle position, which is shown in FIG. 4A, throttle plate 36 is substantially closed, and only a small amount of air is allowed to be drawn through the carburetor; fuel is supplied to the airstream and is allowed to pass through carburetor 22 by means of idle circuit 54 having a fuel supply orifice located downstream of the throttle plate, or an axially arranged plurality of axially spaced fuel supply orifices 56, 58, 60 (as shown), at least one of which is located downstream of throttle plate 36. Fuel supply orifices 56, 58, 60 are sequentially exposed to low air pressure as throttle plate 36 opens from its substantially closed, idle position, to a slightly more open, off-idle position during acceleration from idle as shaft 40 is rotated. This "progressive" system of idle fuel orifices is well known in the art, and is disclosed, for example, in U.S. Pat. No. 4,360,481 to Kaufman, the disclosure of which is expressly incorporated herein by reference. Idle fuel orifices 56, 58, 60 are provided in the wall surface of the carburetor's air flow passage, and open into idle fuel chamber 62 which is supplied with liquid fuel by idle circuit 54. Notably, idle fuel outlets 56, 58, 60 may be located in a diverging portion of the carburetor's venturi and airflow passage, the diverging portion serving as a diffuser which causes the pressure of the air flowing past the idle fuel supply orifice(s) to be increased. The flow of the liquid fuel through the idle circuit, and thus the idle speed of the engine, is controlled through an idle feed restrictor comprising screw 64 as shown.

It is to be noted that at least one of the idle fuel orifices (i.e, orifice 56, the "primary" fuel orifice) is at all times downstream of throttle plate 36. As the throttle plate is opened slightly during acceleration from idle, first progressive orifice 58 and second progressive orifice 60 sequentially become downstream of the opening throttle plate, and additional fuel/air emulsion is provided therethrough to aid in the engine's smooth acceleration to an off-idle speed. Air is received within chamber 62 through idle air bleed orifice 66 located in the wall surface of the carburetor's air flow passage, upstream of the throttle plate, and is mixed with liquid fuel in chamber 62 to produce therein an idle fuel/air emulsion which is delivered to the airstream through at least idle fuel supply orifice 56, and perhaps through orifices 58 and/or 60 as well. The admixed air and fuel is then delivered to cylinder 30 to support the idle running condition of the engine.

As the throttle is opened from its idle position, the pressure of the air flowing through venturi throat 38 drops with the increasing speed of air moving therethrough. A main fuel/air emulsion is thus drawn to venturi portion 34 at or near its throat 38 through main jet nozzle 44 to support the faster running condition of the engine. Because throttle plate 36 is now no longer substantially closed, a greater amount of air is allowed to pass through the carburetor; the pressure of the air flowing across the idle fuel outlets 56, 58, 60 is increased, and a lesser amount of fuel is provided to the airstream by idle circuit 54. At high engine running speeds, with throttle plate 36 substantially fully opened, the vacuum condition at or near venturi throat 38 is even greater, owing to the higher velocity of the air flowing therethrough; further, the air pressure at the idle fuel outlets 56, 58, 60 is even higher, and still less fuel is delivered to the airstream by idle circuit 54.

The idle circuit is typically one of two types relative to the main fuel circuit, the latter comprising main jet well 48 and main nozzle 44: (1) the idle circuit may be a separate circuit entirely which parallels the main circuit, with liquid fuel supplied from the carburetor's fuel supply bowl 50 to the idle circuit and main jet well independently; or (2) as shown in FIG. 4A, idle circuit 54 may be "married" to the main fuel circuit by having its supply passageway 68 in exclusive fluid communication with main jet well 48. Separate idle and main fuel circuits may lead to undesirable emissions during the transition from idle to off-idle running conditions, however, for the pressure of the air flowing across the idle fuel orifices 56, 58, 60 may still be low enough to draw fuel therefrom during the transition, causing the engine to temporarily run too rich; thus married systems are often preferred for reduced engine emissions.

In addition to its separated or married main and idle fuel circuits, some carburetors may utilize a third fuel circuit which also provides fuel to the airflow passage, at a location upstream of the throttle plate and intermediate the outlets of the main jet and the idle fuel circuit. This third fuel circuit may be referred to as a "secondary fuel circuit", for it is secondary to the main fuel circuit from which it may be supplied with fuel. Published PCT International Application WO 98/55757, for example, discloses embodiments of carburetors having such secondary fuel circuits. With reference to FIGS. 1–4 of this PCT application, a first embodiment is disclosed having two such secondary fuel circuits. One of the two secondary fuel circuits (14) has a single fuel outlet (28F) which opens into the airflow passageway of the carburetor upstream of the throttle plate and idle fuel orifice (s); this secondary fuel circuit is in communication with the main fuel circuit and is provided with its air/fuel emulsion thereby. The other secondary fuel circuit (14A) has a spaced plurality of fuel outlets (28A, 28B, 28C, 28D) which also open into the airflow passageway upstream of the throttle plate and the idle fuel orifice(s); this secondary fuel circuit is also in communication with the main fuel circuit, from which it is supplied with an air/fuel emulsion. The fuel delivered to the airflow passageway through the secondary fuel circuit outlets (28A, 28B, 28C, 28D, 28F) is disclosed to be in a highly vaporized state, and the different locations of these outlets along the airflow passageway, where different airflow characteristics are anticipated, supposedly provide fuel delivery which is more responsive to changing airflow conditions vis-a-vis carburetors without such secondary fuel circuit(s).

The above-mentioned PCT application also discloses another embodiment of a carburetor having such a secondary fuel circuit. With reference to FIG. 5 of that application, the carburetor includes an idle circuit which is provided with fuel through an idle supply passage (105A). A secondary fuel delivery circuit (14B) receives an air/fuel emulsion from the main fuel circuit, and includes an intermediate circuit (105) having a single fuel delivery orifice (28F) which opens into the airflow passage intermediate the main and idle fuel outlets, upstream of the throttle plate. The intermediate fuel circuit (105) receives fuel from both the main fuel circuit, and from the idle circuit through an idle transfer passage (104) which interconnects the idle circuit and the secondary fuel delivery circuit.

The above-mentioned PCT application also discloses another embodiment of a carburetor having such a secondary fuel circuit. With reference to FIG. 6 of that application, the carburetor includes an idle fuel circuit and an intermediate fuel circuit (105) which are each provided with fuel through a supply passage (105A). A secondary fuel circuit (14C) provides an air/fuel emulsion obtained from the main fuel circuit to secondary fuel delivery outlet orifices (28B, 28F) which open into the carburetor's airflow passageway upstream of the throttle plate.

Some engines, such as engine 20, include a mechanical, centrifugal flyweight governor mechanism, such as mechanism 70, best shown in FIGS. 2A and 3, which regulates engine speed. With reference to FIGS. 1–3, 5 and 6, engine 20 includes crankshaft 72 having an eccentric portion (not shown) which is operably coupled to reciprocating piston 32 in the well-known manner, as by a connecting rod. Crankshaft 72 is supported by, and extends through, bearing portions 74, 76 provided in joined crankcase portions 78, 80, respectively, which form the engine crankcase or housing. Within the engine crankcase, crankshaft 72 is provided with a gear (not shown) which is in meshed engagement with camshaft gear 82, which is rotatably fixed to a camshaft (not shown) of known type. The camshaft rotates at one half the speed of the crankshaft and controls the operation of the intake and exhaust valves in the manner well known in the art. Camshaft gear 82 is intermeshed with governor gear 84, which comprises part of governor mechanism 70. Disposed on governor gear 84, and adapted to rotate therewith, is flyweight assembly 86, best shown in FIGS. 5A and 5B, which comprises base 88 to which are pivotally attached a pair of opposed flyweights 90. Flyweights 90 are received in annular recess 92 of governor spool 94, which is slidably disposed on spool shaft 96, as best shown in FIGS. 6A and 6B. End 98 of spool shaft 96 extends through base 88 of the flyweight assembly and is fixed relative to the crankcase. Spool 94 moves axially, i.e., substantially vertically, on shaft 96 between shoulder 100 and snap ring 102 (FIG. 6A).

At higher engine speeds, spool 94 is moved upwards on shaft 96, toward snap ring 102, under the force of flyweights 90 which bear against a surface defining recess 92. The centers of mass of the flyweights pivot outwardly with the increasing rotational speed of governor gear 84, and the portions of the flyweights which are in contact with the spool force the spool upwards on shaft 96. At lower engine speeds, spool 94 has a position closer to shoulder 100, the spool being biased by a spring into this generally downward position and overcoming the upward force attributed to the pivoting flyweights as described further hereinbelow.

As best shown in FIGS. 2 and 3, spool 94 has flat upper surface 104 on which free end 105 of governor rod 106 rests. Rod 106 is supported by bearing portion 108 of crankcase portion 78, through which it extends (FIG. 2), and between bearing portion 108 and spool surface 104, rod 106 is provided with a 90° bend; upward travel of spool 94 along shaft 96 thus induces rotation, relative to the engine crankcase, of governor rod end 109, which protrudes through bearing portion 108. As best shown in FIGS. 1 and 2, lever 110 is rotatably fixed to end 109 of governor rod 106 via clip 112, such that the lever pivots about axis 114 as rod end 109 rotates in bearing portion 108. The orientation between lever 110 and clip 112 may be adjusted and fixed by means of screw 115 (FIG. 1).

Spring 116 is attached to and extends between end 118 of lever 110 and end 120 of pivoting throttle control member 122, the other end 124 of which, on the opposite side of pivot point 126, is moved by means of a conventional push-pull throttle cable (not shown) attached thereto and actuated by the operator. Tension on spring 116 biases lever 110, and thus end 109 of governor rod 106, in a counterclockwise direction about axis 114, as viewed in FIG. 1, thereby imparting a downward biasing force on spool surface 104 through abutting free end 105 of rod 106.

With reference to FIGS. 1–3 and 4A, wire link 128 is attached to and extends between end 118 of lever 110 and crank arm 130 of carburetor throttle plate shaft 40. The above-mentioned counterclockwise bias placed on lever 110 by spring 116 places link 128 in compression, urging throttle plate 36 into an open position. On startup, as the engine speed initially increases in response to this spring-induced bias, the rotation of flyweights 90 will force spool 94 to rise, thereby forcing lever 110 to rotate in a clockwise direction, as viewed in FIG. 1, about axis 114 against the force of spring 116 and move throttle plate 36 towards its closed position via link 128. It will be understood by those skilled in the art that under normal operating conditions, at any desired engine running speed set by the operator, the tension of spring 116 and the force exerted on spool 94 by the flyweights offset one another, and are continually adjusted to maintain the desired engine running speed, the governor opening or closing throttle plate 36 in response to lower or higher engine speeds, respectively, which respectively result from increased or lightened loads on the engine. Thus, the desired engine running speed, once set, is thereafter maintained at a substantially constant level as the governor appropriately opens the throttle in response to an increase in load on the engine to provide more power for accommodating the increased load. The increase in load, recognized by the governor as a decrease in engine speed, decreases the centrifugal force acting on the flyweights, and the spring pulls lever 110 counterclockwise, thereby opening the throttle. A decrease in load, recognized by the governor by an attendant increase in engine speed, increases the centrifugal force action on the flyweights, and the rising spool causes lever 110 to rotate clockwise against the force of spring 116, thereby closing throttle plate 36. Thus the speed of the governed engine is stabilized or maintained at the desired level despite load fluctuations.

As mentioned above, married idle and main fuel circuits are desirable for avoiding the emission concerns associated with separate circuits, but in engines having married fuel systems, governor mechanisms such as that described above may actually cause an unsteadiness of the engine speed during the transition from a high engine running speed condition to an idle condition or vice versa. Here, the vacuum on main jet nozzle 44 during high speed conditions may be so great that it places an undesirably high flow restriction on idle circuit fuel 54. This added restriction may be best understood by characterizing this added restriction as placing the liquid idle circuit fuel in "tension", such that it does not so readily flow to idle fuel outlets 56, 58, 60. Initially, when making the transition from high speed to idle, a too lean condition is experienced, causing the engine speed to reach abnormally low levels. Governor mechanism 70 perceives this reduction in engine speed as an increased load to be accommodated by opening the throttle. The engine speed consequently increases. There being little or no load, however, the governor mechanism reacts to this speed increase by closing the throttle. There again may be too much tension on the fuel in idle circuit 54 to readily achieve a smooth transition to a normal engine idle speed, and the cycle repeats, the governor causing the engine speed to oscillate as it seeks to achieve a stable running condition and thereby creating an undesirable "tug of war" condition on the idle fuel between the sources of vacuum located at the idle fuel outlets 56, 58, 60 and the main nozzle 44.

Referring again to FIG. 4A, idle circuit 54 comprises an interconnected series of conduits or bores 132, 134, 136 which extend between fuel chamber 62 and the idle circuit's source of liquid fuel, passageway 68 which communicates with main jet well 48. Idle circuit restrictor screw 64 is threadedly received in a counterbore provided in cast body 138 coaxially with horizontal bore 134, which is fluidly intermediate substantially vertically extending bores 132 and 136. The opening at the bottom of lowermost vertical idle circuit bore 136 is plugged with ball 140 which seals the bore from fuel bowl 50. Cross bore 144 is provided in cast body 138 and extends from the outer surface thereof, within bowl 50, through bore 136, and into main jet well 48, cross bore 144 partially forming idle circuit fuel supply passageway 68. Passageway 68 also includes orifice 146 provided through the wall of hollow bowl "nut" 148, orifice 146 being aligned with cross bore 144 and serving as a flow restrictor. Orifice 146 provides a flow restriction which may help reduce the severity of, but does not eliminate, the above-described tension condition on the fuel in idle circuit 54. The diameter of orifice 146 may be approximately 0.023 inch. A smaller such restriction may inhibit the ready flow of fuel from main jet well 48 to idle circuit 54. Main jet well 48 is partially defined by hollow, externally threaded bowl nut 148, which secures bowl 50 to cast body 138 of the carburetor, and liquid fuel is received into main jet well 48 through above-described metering jet 52, which extends through the bowl nut.

The opening of the portion of cross bore 144 which lies on the radial side of bore 136 opposite main jet well 48 is plugged with ball 152 which seals that portion of cross bore 144 from the gasoline in fuel bowl 50. The placement of ball 152 within cross bore 144, which is located well below surface level 153 of the liquid fuel in bowl 50, is best shown in FIG. 4B. Thus it can be readily seen that idle circuit 54 is "married" to main jet well 48, and receives its fuel exclusively therefrom, via passageway 68.

As shown in FIG. 4A, main jet nozzle 44 is sealed in its bore 154 by o-rings 156 and 158 respectively located at the top and bottom thereof. Main jet nozzle bore 154 is provided with vent 160 which allows air to travel to the bottom, interior of the main jet nozzle through radial passage 162 therein. An emulsion of air and fuel proceeds upwardly through main jet nozzle 44 and is delivered near throat 38 of the venturi portion of the airflow passage during off-idle running conditions, where the main fuel/air emulsion is mixed with air flowing therethrough.

As described above, under high speed conditions, with a high vacuum placed on outlet end 42 of main jet nozzle 44, fuel in idle circuit 54 may be placed in tension. The flow of liquid idle circuit fuel being so additionally restricted, a ready supply of fuel to idle chamber 62 is prevented. The consequential lack of fuel flow to fuel chamber 62 results in a sharp decrease in engine speed during the transition to idle, which is perceived by the governor as an increased load to be accommodated by opening the throttle of the lightly loaded engine. The resulting high engine speed places a substantial vacuum on the main jet nozzle, which again places the idle circuit fuel in tension. Reacting to the over speeding of the unloaded engine, the governor reacts by closing the throttle to its idle position, and the cycle repeats as the governor again seeks to achieve a stable running condition, an effort which is undermined by the tension being cyclically exerted on the idle circuit fuel by the vacuum on the main jet nozzle. This cycle manifests itself by an undesirable, automatic raising and lowering of the engine speed.

A way of addressing the problem by maintaining a smooth engine running condition during the transition from high speed to idle, while avoiding a too rich condition which can lead to emission concerns, and which may be easily incorporated into previous engine and/or carburetor designs, is highly desirable.

SUMMARY OF THE INVENTION

The present invention provides an increased flow of liquid fuel to the idle circuit and avoids the above-mentioned tension condition being placed on this fuel, which allows sufficient low-speed or idle fuel flow to the idle fuel orifice(s) to be maintained while providing sufficient high-speed or main fuel flow to the main jet well, thereby accommodating smooth transitions between high-speed and low-speed operations.

The present invention may be easily facilitated in existing engine and/or carburetor designs with little or no additional machining or tooling revisions and, unlike the above- mentioned carburetor disclosed in WO 98/55757, without providing any fuel delivery circuits which communicate with the airflow passageway other than the existing idle and main fuel circuits. Indeed, with regard to the particular embodiment of the present invention described herein, it will be appreciated that the present invention may be very readily implemented into the above-described engine (FIGS. 1–3) and/or carburetor (FIG. 4).

The present invention provides the solution to the above-mentioned problem by providing an internal combustion engine including a cylinder, a crankshaft, a reciprocating piston disposed in the cylinder and operably coupled to the crankshaft, and a carburetor. The carburetor includes an airflow passage through which varying amounts of air flows; a variably positioned throttle valve located in the airflow passage, the amount of air flowing through the airflow passage being varied in response to the position of the throttle valve; a source of stored liquid fuel; a well containing liquid fuel and in independent fluid communication with the source of stored liquid fuel; a nozzle extending between the liquid fuel contained in the well and the airflow passage, the nozzle having an outlet located upstream of the throttle valve in the airflow passage, a variable amount of the liquid fuel contained in the well being conveyed through the nozzle to the airflow passage in response to the amount of air flowing through the airflow passage; and an idle circuit in independent fluid communication with both the source of stored liquid fuel and the well, the idle circuit containing liquid fuel and having at least one fuel outlet located in the airflow passage downstream of the throttle valve, a variable amount of the liquid fuel contained in the idle circuit being conveyed to the fuel outlet in response to the amount of air flowing through the airflow passage.

The present invention also provides an internal combustion engine including a cylinder having a piston reciprocatively disposed therein, a crankshaft operably coupled to the piston, and a carburetor having an airflow passage extending therethrough which is in fluid communication with the cylinder. The carburetor has a variably positioned throttle valve located in the airflow passage, and the amount of air flowing through the airflow passage is varied in response to the position thereof. The carburetor also includes a source of stored liquid fuel, a well containing liquid fuel and in fluid communication with the airflow passage at a location upstream of the throttle valve, and an idle circuit containing liquid fuel and in fluid communication with the airflow passage at a location downstream of the throttle valve. The well and the idle circuit are each in independent liquid communication with the source of liquid fuel and with each other.

The present invention also provides an internal combustion engine including a cylinder having a piston reciprocatively disposed therein, a crankshaft operably coupled to the piston, and a carburetor having an airflow passage extending therethrough which is in fluid communication with the cylinder. The carburetor has a variably positioned throttle valve located in the airflow passage, and the amount of air flowing through the airflow passage is varied in response to the position thereof. The carburetor also includes a source of stored liquid fuel, a well containing liquid fuel and in fluid communication with the airflow passage at a location upstream of the throttle valve, an idle circuit containing liquid fuel and in fluid communication with the airflow passage at a location downstream of the throttle valve, and means for providing the idle circuit with liquid fuel directly from the source of liquid fuel and with liquid fuel directly from the well in amounts which respectively vary with engine speed.

The present invention also provides a carburetor including an airflow passage through which varying amounts of air flows; a variably positioned throttle valve located in the airflow passage, the amount of air flowing through the airflow passage being varied in response to the position of the throttle valve; a source of stored liquid fuel; a well containing liquid fuel and in independent fluid communication with the source of stored liquid fuel; a nozzle extending between the liquid fuel contained in the well and the airflow passage, the nozzle having an outlet located upstream of the throttle valve in the airflow passage, a variable amount of the liquid fuel contained in the well being conveyed through the nozzle to the airflow passage in response to the amount of air flowing through the airflow passage; and an idle circuit in independent fluid communication with the source of stored liquid fuel and the well, the idle circuit containing liquid fuel and having at least one fuel outlet located in the airflow passage downstream of the throttle valve, a variable amount of the liquid fuel contained in the idle circuit being conveyed to the fuel outlet in response to the amount of air flowing through the airflow passage.

The present invention also provides a carburetor having an airflow passage extending therethrough, the carburetor including a variably positioned throttle valve located in the airflow passage, the amount of air flowing through the airflow passage being varied in response to the position of the throttle valve, a source of stored liquid fuel, a well containing liquid fuel and in fluid communication with the airflow passage at a location upstream of the throttle valve, and an idle circuit containing liquid fuel and in fluid communication with the airflow passage at a location downstream of the throttle valve, the well and the idle circuit each being in independent liquid communication with the source of liquid fuel and with each other.

The present invention also provides a carburetor having an airflow passage extending therethrough, the carburetor including a variably positioned throttle valve located in the airflow passage, the amount of air flowing through the airflow passage being varied in response to the position of the throttle valve, a source of stored liquid fuel, a well containing liquid fuel and in fluid communication with the airflow passage at a location upstream of the throttle valve, an idle circuit containing liquid fuel and in fluid communication with the airflow passage at a location downstream of the throttle valve, and means for providing the idle circuit with liquid fuel directly from the source of liquid fuel and with liquid fuel directly from the well in amounts which respectively vary with the amount of air flowing through the airflow passage.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
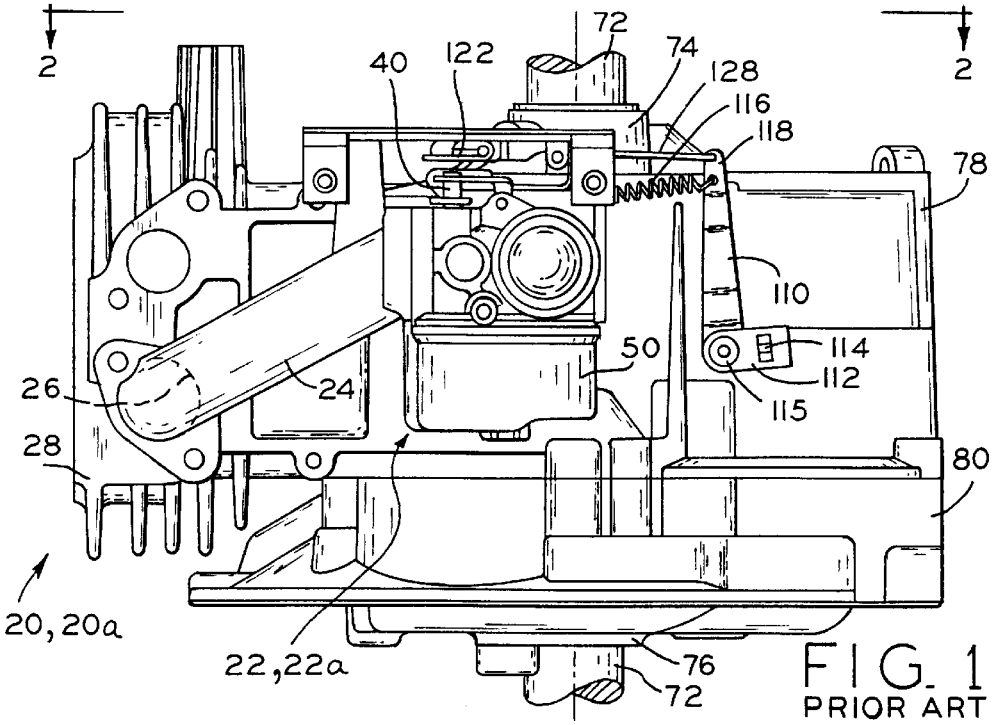
FIG. 1 PRIOR ART
FIG. 1 is a side view of a previous engine.

Corresponding reference characters indicate corresponding parts throughout the several views. Although the drawings represent an embodiment of the present invention, the drawings are not necessarily to scale and certain features may be exaggerated or simplified in order to better illustrate and explain the present invention. The exemplification set out herein illustrates an embodiment of the invention in one form, and such exemplification is not to be construed as limiting the scope of the invention in any manner.

DETAILED DESCRIPTION OF THE INVENTION

Figure 2:
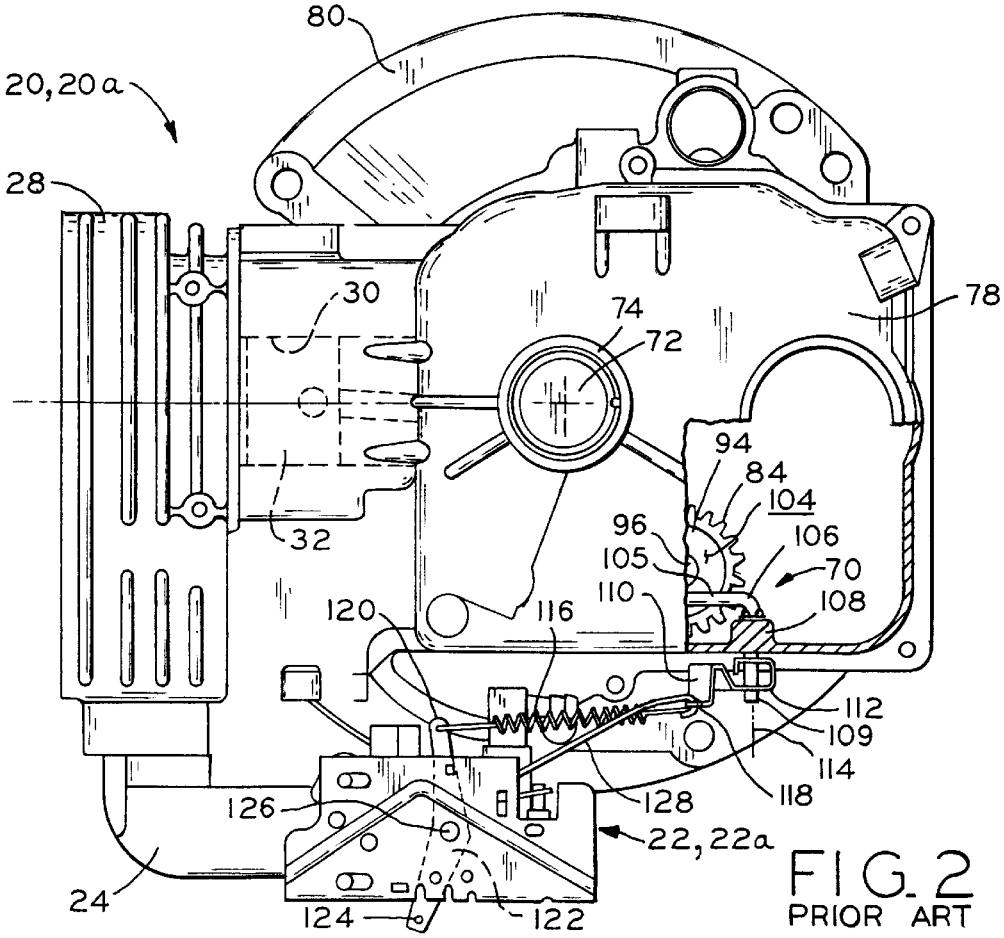
FIG. 2 PRIOR ART
FIG. 2 is a view of the engine of FIG. 1 along line 2—2.
Figure 3:
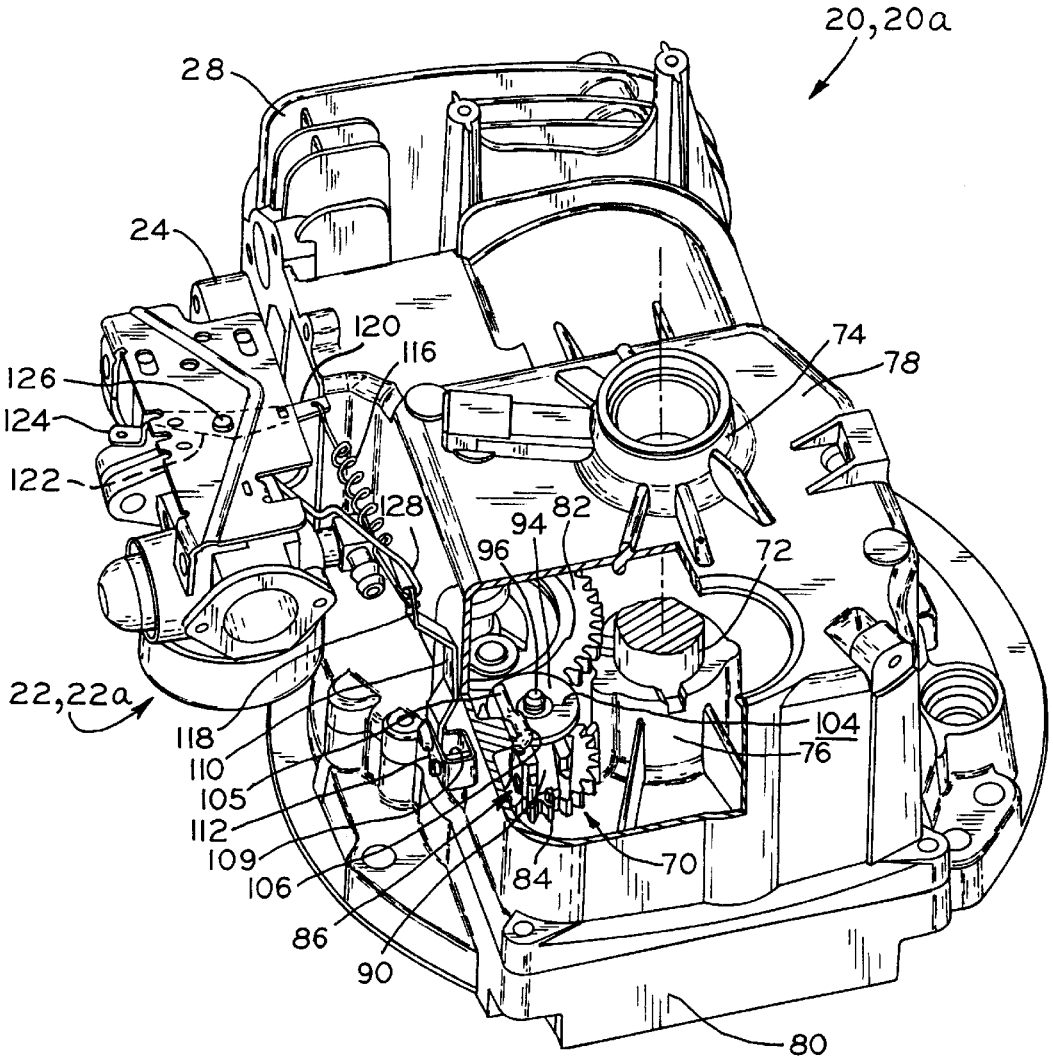
FIG. 3 PRIOR ART
FIG. 3 is a partially broken-away upper perspective view of the engine of FIG. 1.
Figure 4A:
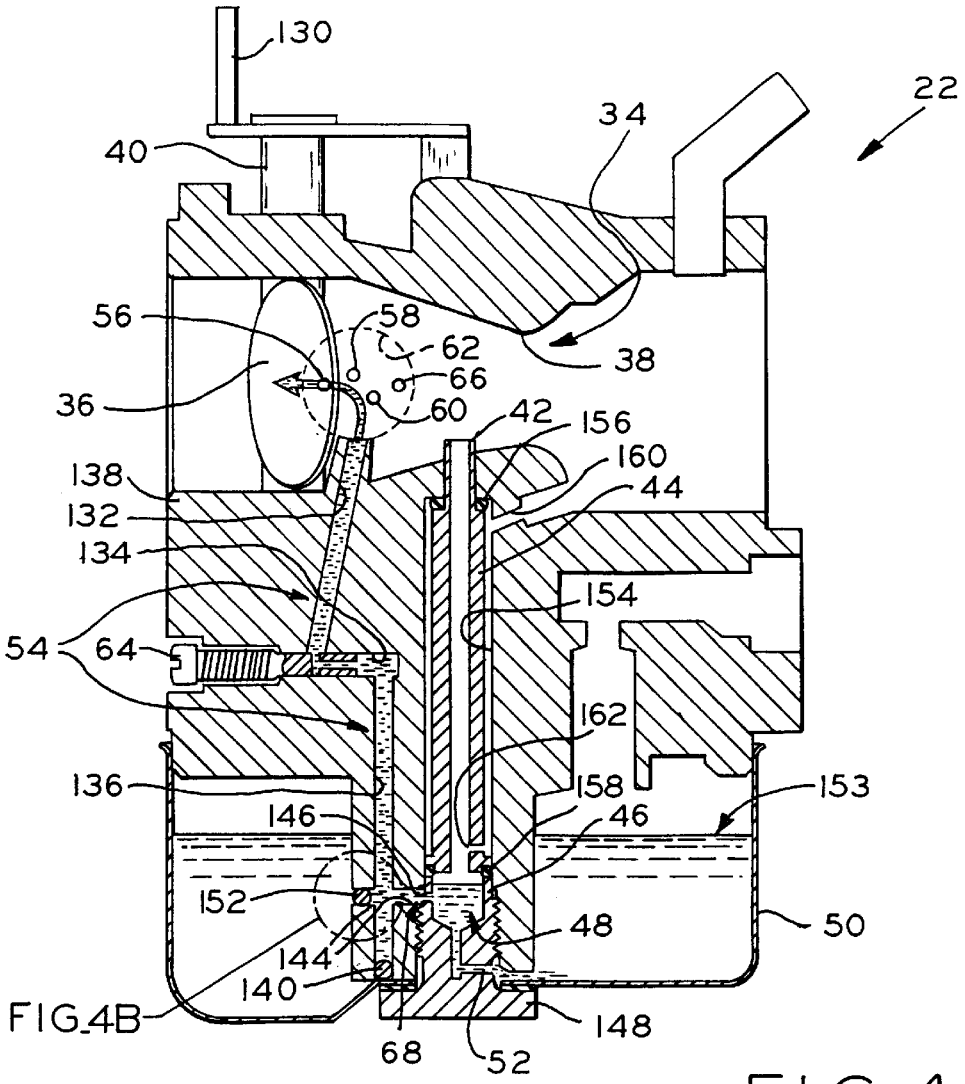
FIG 4A PRIOR ART
FIG. 4A is a schematic sectional side view of the carburetor of the engine of FIG. 1, at idle speed operation, showing its married idle circuit.
Figure 4B:
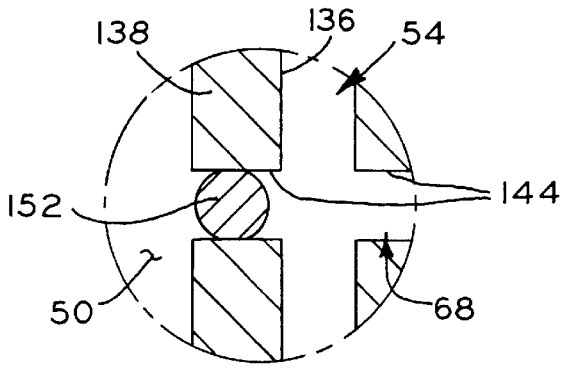
FIG 4B PRIOR ART
FIG. 4B is an enlarged view of the encircled area in FIG. 4A.
Figure 5A:
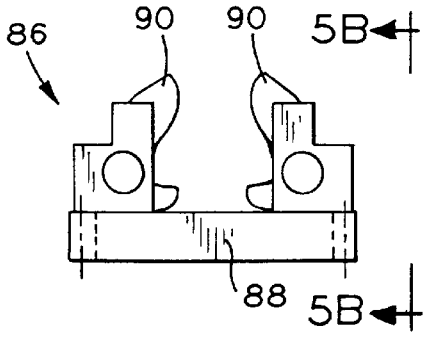
FIG. 5A PRIOR ART
FIG. 5A is a side view of a governor mechanism flyweight assembly.
Figure 5B:
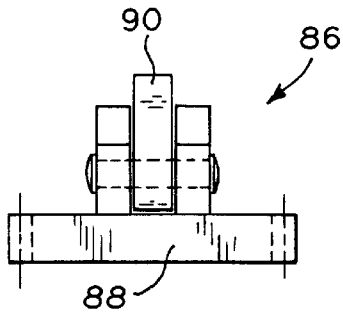
FIG. 5B PRIOR ART
FIG. 5B is a view of the flyweight assembly of FIG. 5A along line 5B—5B.
Figure 6A:
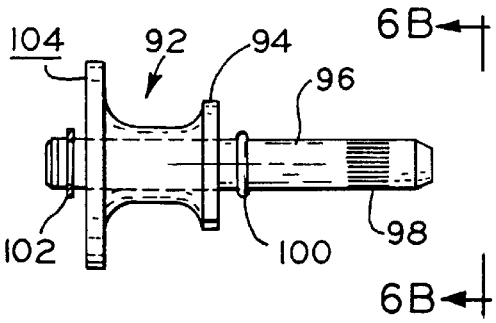
FIG. 6A PRIOR ART
FIG. 6A is a side view of a governor mechanism spool and a shaft assembly.
Figure 6B:
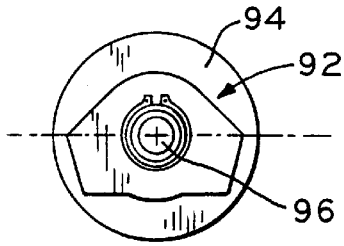
FIG. 6B PRIOR ART
FIG. 6B is a view of the spool and shaft assembly of FIG. 6A along line 6B—6B.
Figure 7A:
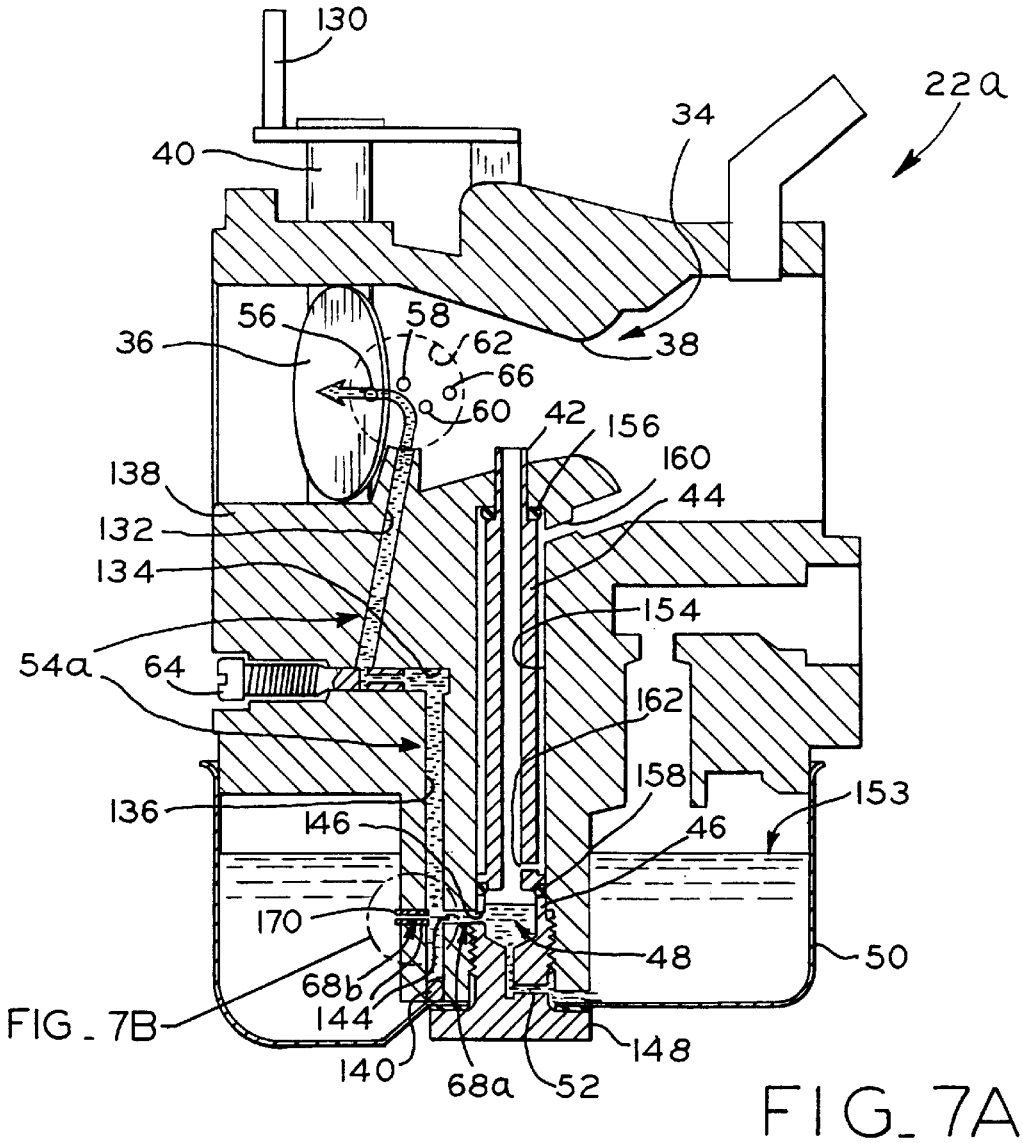
FIG. 7A is a schematic sectional side view of one embodiment of a carburetor for an engine according to the present invention, at idle operation.
Figure 7B:
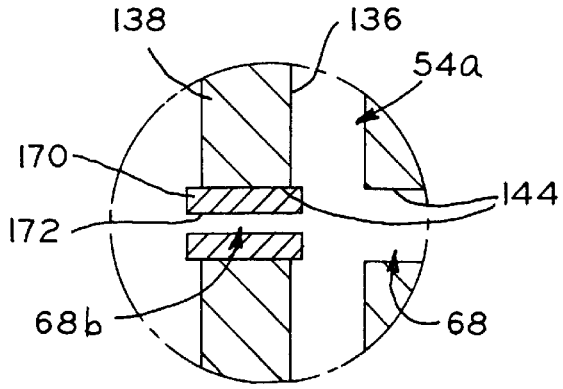
FIG. 7B is an enlarged view of the encircled area in FIG. 7A.
Figure 8:
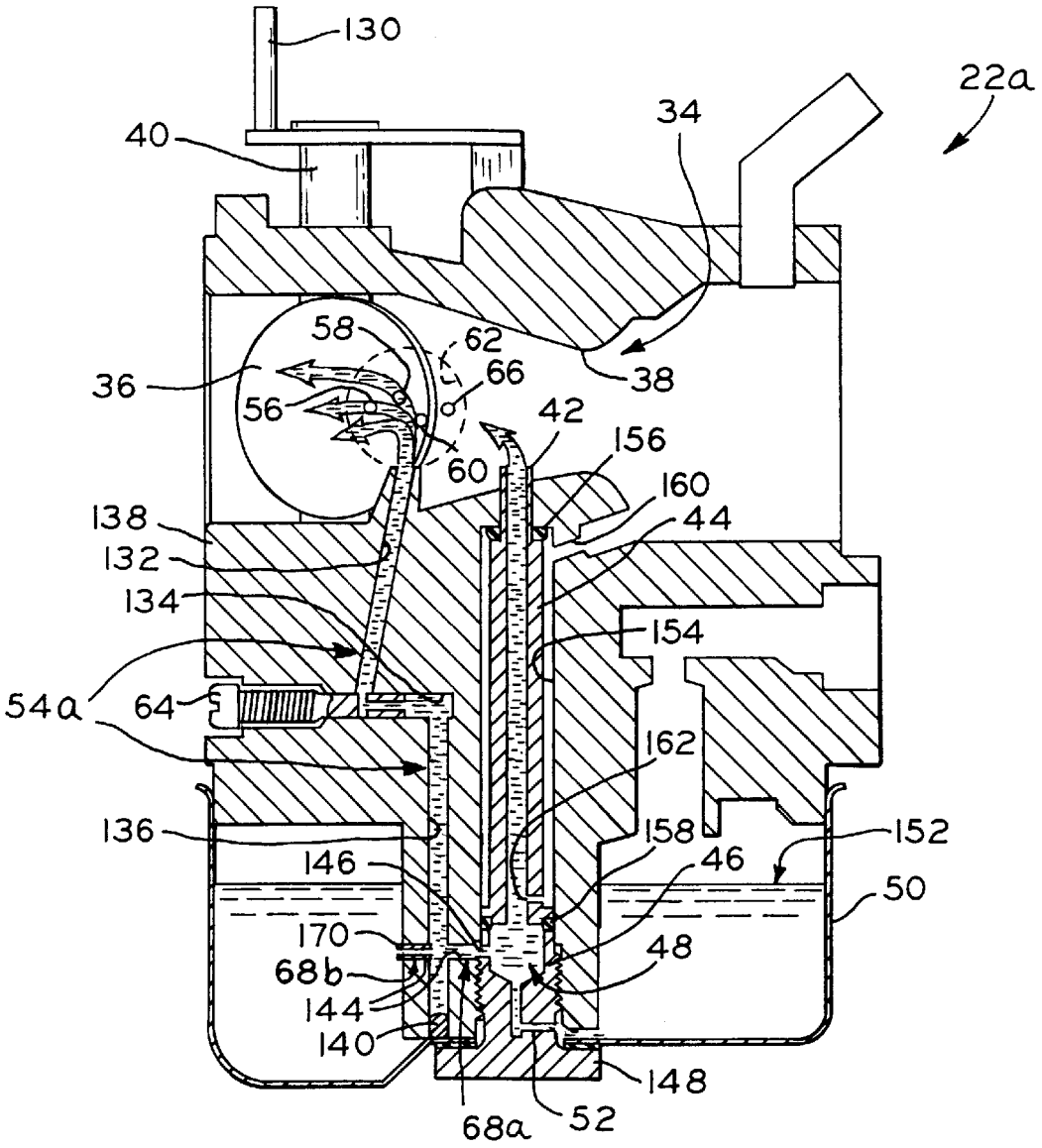
FIG. 8 is a schematic sectional side view of the carburetor of FIG. 7, at intermediate or transitory operation from low-speed (idle) operation to high speed operation.
Figure 9:
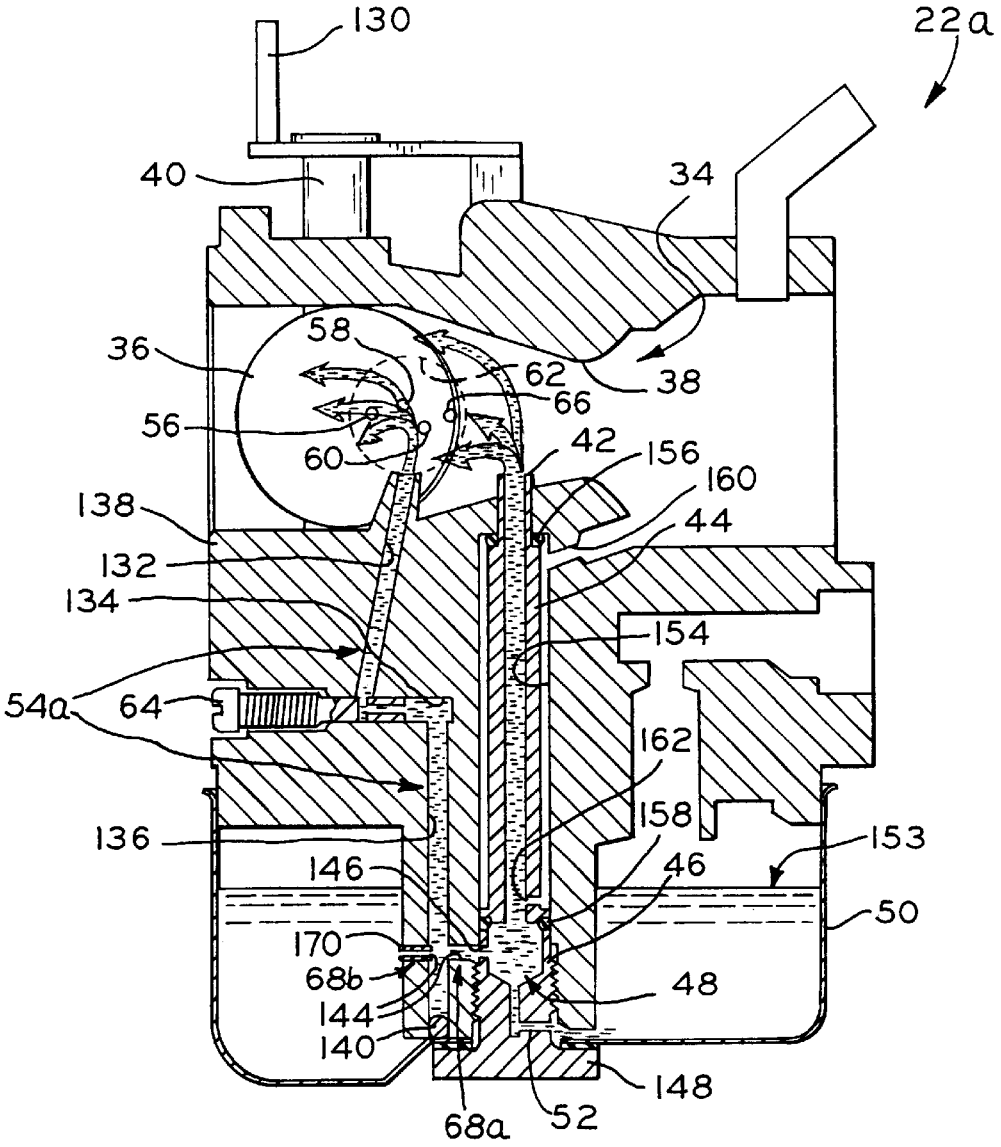
FIG. 9 is a schematic sectional side view of the carburetor of FIG. 7, at high-speed operation.

One embodiment of an engine according to the present invention is engine 20*a*, which is identical in structure and operation to previous engine 20 of FIGS. 1–3 with the exception that above-described carburetor 22 is replaced by inventive carburetor 22*a*. Carburetor 22*a*, shown in FIGS. 7–9, is one embodiment of a carburetor according to the present invention and is structurally and functionally identical to carburetor 22 except as described hereinbelow. It is to be understood that the reference to inventive engine 20*a* and inventive carburetor 22*a* in prior art FIGS. 1–3 is intended merely to reflect the otherwise identical structure between the previous engine and carburetor and the embodiments of the inventive engine and carburetor described herein.

In carburetor 22*a*, ball 152, which had previously plugged the opening of cross bore 144 in carburetor 22, has been replaced with cylindrical fitting 170 which is press-fitted into the cross bore. Fitting 170, which may be made of a suitable metal or plastic material, has axial bore 172 therethrough which is approximately 0.013 to 0.014 inch in diameter, and serves as a flow restrictor. As mentioned above, and is clear from the drawings, cross bore 144, and thus fitting 170, is located well below surface level 153 of the fuel in bowl 50. Fitting 170 thus provides a bridge between the fuel in the bowl and that in the idle circuit. Thus, as best shown in FIG. 7B, in carburetor 22*a*, the idle circuit is in fluid communication with both main jet well 48, through passageway 68*a* which is identical to passageway 68 of prior carburetor 22, and the fuel in bowl 50, through passageway 68*b* formed by fitting bore 172. Hereinbelow, fitting 170 may also be referred to as a "bridge restrictor," and passageways 68*a* and 68*b* may be said to form a "bridge passageway." Except for the above-mentioned replacement of ball 152 with fitting 170, idle circuit 54*a* of carburetor 22*a* is identical to idle circuit 54 of carburetor 22.

During idle operation (FIG. 7A) carburetor 22*a*, like carburetor 22, is designed to supply, via the idle circuit, a fuel/air emulsion into the airstream downstream of throttle plate 36 during slow speed or very light load conditions of the engine. As described above, during idle conditions the airflow through the carburetor air passage is restricted by the throttle plate, which is slightly open. In carburetor 22*a*, the majority of the idle fuel is supplied to idle circuit 54*a* from main jet well 48, this fuel received through passageway 68*a*. A lesser amount of idle fuel is supplied to idle fuel circuit 54*a* through bridge restrictor 170. The total amount of idle fuel is then drawn up bore 136 to bore 134 and through the restriction provided by screw 64, and then upwards through bore 132 to chamber 62 where it is mixed with idle bleed air to create the idle fuel emulsion. This emulsion is then drawn through idle primary feed orifice 56 and to cylinder 30 as described above.

During intermediate operation (FIG. 8), which is transitory between low-speed (idle) and high-speed operation, as the throttle valve begins to open the incoming air column speed through the carburetor air passage increases, and as it increases main jet nozzle 44 begins to feed small amounts of main fuel/air emulsion to the airstream. Fuel being drawn up main jet nozzle 44 from well 48 results in a tension being placed on the liquid fuel that was just previously flowing to chamber 62 during the idle operation, thereby restricting the idle fuel's ability to flow to chamber 62. This tension causes fuel in bowl 50 to begin flowing more rapidly from bowl 50 through bridge restrictor 170 and into idle circuit 54*a*. The increased flow of fuel from bowl 50 to idle circuit 54*a* through passageway 68*b* allows sufficient low-speed or idle fuel flow to chamber 62 to be maintained while providing sufficient high-speed or main fuel flow to well 48, thereby smoothly completing the transition from low-speed to high-speed operation. During this intermediate operation, transitory mode, the source of the majority of the idle fuel supply flow changes from being well 48, via passageway 68*a*, to being bowl 50, via passageway 68*b*.

During high-speed operation, throttle valve 36 is substantially open and allows sufficient volumes of air to flow through the carburetor to sufficiently meet engine fuel requirements based on load and/or speed. During such operation, main jet nozzle 44 supplies the majority of the engine's total fuel demand. The idle system continues to provide fuel, although an amount relatively smaller than that provided by the main system. Nevertheless, the amount of fuel being provided by the idle circuit to engine cylinder 30 during high-speed operation has a significant effect on the overall fuel delivery. During the high-speed operation mode, the main fuel is metered by metering jet 52 in bowl nut 148 which fluidly communicates well 48 with bowl 50. Meanwhile, the idle circuit is primarily supplied with fuel from bowl 50 through bridge restrictor 170 (passageway 68*b*); a small amount of fuel is received into idle circuit 54*a* from well 48 through orifice 146 (passageway 68*a*). Because the column of fuel in idle circuit 54*a* is not placed in tension, as is the column of fuel in previous idle circuit 54, this fuel is immediately available to support idle conditions smoothly upon closing of the throttle, without causing the governor mechanism to oscillate the throttle in an attempt to achieve a stable running condition.

While this invention has been described as having an exemplary design, the present invention may be further modified within the spirit and scope of this disclosure. This application is therefore intended to cover any variations, uses, or adaptations of the invention using its general principles. For example, the scope of the present invention is to be understood as encompassing carburetors having more than one main jet and/or more than one idle circuit, as well as carburetors for two-cycle engines. Further, this application is intended to cover such departures from the present disclosure as come within known or customary practice in the art to which this invention pertains.

What is claimed is:

1. A carburetor having an airflow passage therethrough, said carburetor comprising:

a bowl in which liquid fuel is disposed, the liquid fuel in said bowl having a surface level;

a well containing liquid fuel, said well and said airflow passage in fluid communication with each other;

a bridge passageway having an inlet from said bowl and located below said surface level, said bridge passageway extending between said inlet and said well; and an idle fuel passageway connected to said bridge passageway at a location intermediate said bridge passageway inlet and said well, said idle fuel passageway in fluid communication with said airflow passage; and wherein said idle fuel passageway is provided with liquid fuel through said bridge passageway from both said bowl and said well.

* * * * *